US007497161B2

(12) United States Patent
Jensen et al.

(10) Patent No.: US 7,497,161 B2
(45) Date of Patent: Mar. 3, 2009

(54) PRINTING WITH FLEXOGRAPHIC INKS AND LACQUER

(75) Inventors: Jesper Ravn Jensen, Bjert (DK); Erik Gydesen, Vejle (DK); Henrik Leimand, Bjert (DK)

(73) Assignee: Tresu Anlæg A/S, Bjert (DK)

( * ) Notice: Subject to any disclaimer, the term of this patent is extended or adjusted under 35 U.S.C. 154(b) by 440 days.

(21) Appl. No.: 10/551,210

(22) PCT Filed: Apr. 1, 2004

(86) PCT No.: PCT/DK2004/000230

§ 371 (c)(1),
(2), (4) Date: Sep. 28, 2005

(87) PCT Pub. No.: WO2004/087422

PCT Pub. Date: Oct. 14, 2004

(65) Prior Publication Data

US 2006/0191429 A1 Aug. 31, 2006

(30) Foreign Application Priority Data

Apr. 1, 2003 (DK) ..... 2003 00502

(51) Int. Cl.
*B41F 7/02* (2006.01)

(52) U.S. Cl. ..... 101/217; 101/147; 101/350.6

(58) Field of Classification Search ..... 101/217, 101/147, 148, 177, 350.6, 351.6, 137
See application file for complete search history.

(56) References Cited

U.S. PATENT DOCUMENTS

| | | | | | |
|---|---|---|---|---|---|
| 3,115,904 | A | * | 12/1963 | Small et al. | 140/93 R |
| 3,645,201 | A | | 2/1972 | Jackson | |
| 4,223,604 | A | * | 9/1980 | Brehm et al. | 101/415.1 |
| 4,932,294 | A | * | 6/1990 | Chang | 81/490 |
| 5,413,038 | A | | 5/1995 | Josl-Enneking et al. | |
| 5,740,739 | A | | 4/1998 | Herold et al. | |
| 6,971,310 | B1 | * | 12/2005 | Christiansen | 101/350.6 |
| 2002/0073864 | A1 | | 6/2002 | Kolbe et al. | |

FOREIGN PATENT DOCUMENTS

| | | | |
|---|---|---|---|
| DE | 3710300 | | 1/1988 |
| EP | 0884175 | | 12/1998 |
| EP | 1029671 | | 8/2000 |
| EP | 1093913 | A2 | 4/2001 |
| EP | 1093913 | A3 | 9/2001 |
| WO | WO 99/01282 | | 1/1999 |
| WO | WO 9901282 | A1 * | 1/1999 |
| WO | WO 01/25010 | | 4/2001 |

* cited by examiner

*Primary Examiner*—Daniel J Colilla
*Assistant Examiner*—David Banh
(74) *Attorney, Agent, or Firm*—James Creighton Wray

(57) ABSTRACT

There is described a printing unit and a method for printing with flexographic inks. The printing unit includes a screen roller engaging a doctor blade system (3), and which is in continuous operation, either by engaging a motor (10) or by operation by the transmission (2) of the printing machine. The screen roller (1) of the printing unit interacts with a rubber sheet (16) which is disposed on a rubber sheet cylinder (4) at a position between a printing plate cylinder (5) and a back-pressure cylinder (6). A slot (7) is provided in the rubber sheet, used when the screen roller (1) is to be engaged with the rubber sheet (17).

10 Claims, 6 Drawing Sheets

PRINTING WITH FLEXOGRAPHIC INKS AND LACQUER

This application claims the benefit of Danish Application No. PA 2003 00502 filed Apr. 1, 2003 and PCT/DK2004/000230 filed Apr. 1, 2004, which are hereby incorporated by reference in their entirety.

BACKGROUND OF THE INVENTION

The present invention concerns a printing unit for printing with flexographic inks and lacquer in an offset printing machine that includes a printing plate cylinder, a rubber sheet cylinder, a back-pressure cylinder and an inking unit which includes a screen roller in engagement with a doctor blade system and which is arranged for continuous rotation, either by engaging a motor in a situation where the printing machine is not operating or by engaging the transmission of the printing machine when the printing machine is operating, the screen roller being arranged for swinging in and out of engagement with rubber sheet cylinder which has an axially oriented channel limited by the front edge and the rear edge of the rubber sheet.

The invention further concerns a printing machine with such a printing unit and a tool for use in mounting and dismounting the washing facility and the inking unit in such a printing machine.

The invention furthermore concerns a method of operation for printing with flexographic inks and lacquer in an offset printing machine which includes a printing plate cylinder, a rubber sheet cylinder, a back-pressure cylinder and an inking unit which includes a screen roller engaging a doctor blade system and which is continuously rotated, either by engaging a motor in a situation where the printing machine is not operating or by engaging the transmission of the printing machine when the printing machine is operating, the screen roller being arranged for swinging in and out of engagement with rubber sheet cylinder which has an axially oriented channel limited by the front edge and the rear edge of the rubber sheet It is prior art to produce printing machines in which are placed different printing units, so that an offset printing machine also can be used with flexographic inks and lacquer. Examples of such prior art machines of the kind mentioned in the introduction are found e.g. in PCT/DK98/000303 and in EP 1 093 913.

The reason of the present invention is a need for providing a modular system, where a washing facility for the rubber sheet cylinder in a printing unit readily may be substituted with an inking unit, and where there is no risk that ink in the screen roller of the inking unit dries up simultaneously with enabling driving the inking unit by the transmission found in the printing machine in order to provide an operation of the printing unit which is entirely synchronous with the number of revolutions of the rubber sheet.

When the printing unit is of the type with screen roller engaging a doctor blade system, problems will arise with drying of ink/lacquer in the screen roller when the printing machine is standing still or when the screen roller is brought out of engagement with the rubber sheet cylinder, as the screen roller is not rotating in these situations.

When changing the printing machine by shifting between the washing facility and the inking unit, it is important that this occurs very quickly for reducing the down-time of the machine. By the known machines it is furthermore an ergonomically inconvenient task to perform substitution, since washing facilities usually are positioned obliquely under the rubber sheet cylinder. Therefore, it is difficult for an operator to get a real hold on the washing facility/inking unit. This also implies risk of the washing facility/printing unit falling down and causing damage of parts in printing machine and/or the washing facility/inking unit.

SUMMARY OF THE INVENTION

It is thus the purpose of the present invention to indicate a system including a printing unit, a printing machine, a tool and a method of the types mentioned in the introduction that enable remedying of the problems connected with the prior art printing units and methods.

This is achieved according to the present invention with a printing unit which is peculiar in that the inking unit is adapted for being mounted in the support holder of the printing machine for a washing facility for the rubber sheet on the rubber sheet cylinder.

The printing machine according to the invention is peculiar in that at each end of the inking unit there are projecting guide means which are arranged for interacting with at least one guide groove formed in the support holder of the printing machine at each end of the rollers and which interacts with projecting guide means on the washing facility.

The tool according to the invention for use in mounting and dismounting the washing facility and the inking unit is peculiar in that it includes two side plates that each are provided with positioning means interacting with corresponding positioning means in the support holder of the printing machine and auxiliary guide grooves that are aligned with the guide grooves in the support holder of the printing machine when the positioning means engage, the guide grooves and auxiliary guide grooves being adapted for receiving the washing facility/inking unit at a position situated under carrier handles formed at an upper side of the tool, preferably on the side plates, and which is used for lifting when mounting and dismounting the washing facility and the inking unit.

The method according to the invention is peculiar in that the inking unit is displaced in the support holder for a washing facility for the rubber sheet on the rubber sheet cylinder for mounting and dismounting, respectively, when substituting with the washing facility.

As the inking unit is modular and can be displaced in the support holder of the printing machine, a rapid and easy change of the printing machine is achieved for mounting or dismounting the washing facility and the inking unit, respectively. This may occur particularly rapidly and simply by using the tool according to the invention.

The screen roller in the inking unit will rotate continuously. During usual operation of the printing unit, where it is essential that the screen roller is running synchronously with the rubber sheet, rotation is established by engagement with the transmission of the printing machine. This may e.g. occur via a driving gear wheel located at an internal side of the side frame of the printing unit and engaging the driving gear wheel on the inking unit shaft on which the screen roller is mounted. Hereby is achieved a 100% accurately synchronised transmission that ensures correct speed between the rubber sheet cylinder of the printing machine and the screen roller of the inking unit. As opposed to using an independent drive motor, e.g. servomotor for driving the inking unit, there will be no tolerance problems with regard to number of revolutions of rubber sheet and screen roller, respectively.

In order to ensure continuous rotation when the screen roller is swung out from its engagement with the rubber sheet, a motor running with constant rotational speed has been provided. This motor can drive the screen roller independently of the operation of the printing machine. The motor is permanently integrated in the inking unit of the printing machine (offset printing unit) and is therefore not to be installed each time the inking unit is to be used. The used principle is also called idling for the inking unit. Furthermore, the inking unit will require less maintenance than an inking unit driven by an independent drive unit, e.g. a servomotor.

The printing unit according to the invention is primarily intended for use with printing machines that are adapted to printing on sheets. By using the inking unit, the printing unit is changed from an offset printing unit to a lacquering unit/flexographic unit, where lacquer/ink from the screen roller is deposited on the rubber sheet in a way corresponding to a cliché in flexographic printing. The print is then passed further down onto the sheet. The inking unit of the printing unit is structured as a modular arrangement that may be placed in grooves/fittings used for the printing unit washing facility for the rubber sheet Rapid shifting between washing facility and inking unit is possible with the tool according to the invention. The grooves of the tool furthermore provide secure guiding of washing facility as well as inking unit so that there is no risk of damaging parts of the unit while making the change.

According to a particular embodiment, the printing unit is peculiar in that the screen roller is arranged for swinging against the rubber sheet cylinder opposite the duct in order to be in contact with the rubber sheet from its front edge. The screen roller will be arranged for swinging away from the rubber sheet cylinder opposite the channel in order to be in contact with the rubber sheet to its rear edge. In practice, the swinging is performed when the penultimate sheet in a printing series is inserted in the printing unit.

Before the printing unit is put into use, it is important that there is spacing between the rubber sheet and the printing plate cylinder. According to one embodiment, this occurs in practice by dismounting the pressure plate, as lacquer can otherwise be deposited on the printing plate with consequent risk that the lacquer is passed further up into the printing unit. Furthermore, it is noted that the moistening unit of the printing machine is to be disconnected.

No offset ink is to come on the rubber sheet where the printing unit is used for printing. Therefore, it is important to have the entire sheet lacquered from the front edge since the rubber sheet and printing result otherwise can be destroyed. If there is no lacquer on the rubber sheet, the offset ink is drawn from the sheet up on the rubber sheet.

For ensuring that a first sheet moved through the printing machine is fully lacquered, it is important that the printing unit is printing from the front edge of the first sheet and not at an earlier time. This is ensured by establishing the screen roller engagement opposite to the axially oriented channel. At commencing pressure, the screen roller of the printing unit is thus moved in against the rubber sheet cylinder in a position from the axially oriented channel in the rubber sheet cylinder. Therefore, contact with the rubber sheet will be established from its front edge. If there is lacquer on the rubber sheet at an earlier time than the time where a first sheet is inserted into the printing unit, the lacquer will be transferred from the rubber sheet cylinder to the back-pressure cylinder, which is not acceptable.

As mentioned, the sheet is to be provided with lacquer across its entire length, and therefore it is important that the screen roller can be in contact with the rubber sheet for applying lacquer to the rear edge of the rubber sheet. When at a position opposite the channel beyond the rear edge, it is possible to swing out the screen roller.

It is important that the last sheet in a print series coming through the printing unit is lacquered completely. However, the screen roller will usually be swung back from the rubber sheet before the sheet has entered the printing unit. Thereby it is ensured that the rubber sheet is not filled with lacquer at the end of a printing process. In practice, this occurs by the screen roller being swung out before the last sheet in a series of print being inserted in contact with the rubber sheet.

According to a further embodiment, the printing unit is peculiar in that interacting bearing means on the inking unit and the printing machine are provided for adjusting the contact pressure of the inking unit against the rubber sheet. Hereby is ensured correct contact pressure for optimising ink deposition during printing and possibility for compensating for difference in mutual position of the cylinders, e.g. as a consequence of different thickness on the sheets.

DESCRIPTION OF DRAWING

The invention will now be explained more closely with reference to the accompanying drawing, where.

DETAILED DESCRIPTION OF THE PREFERRED EMBODIMENTS

Figure 1:
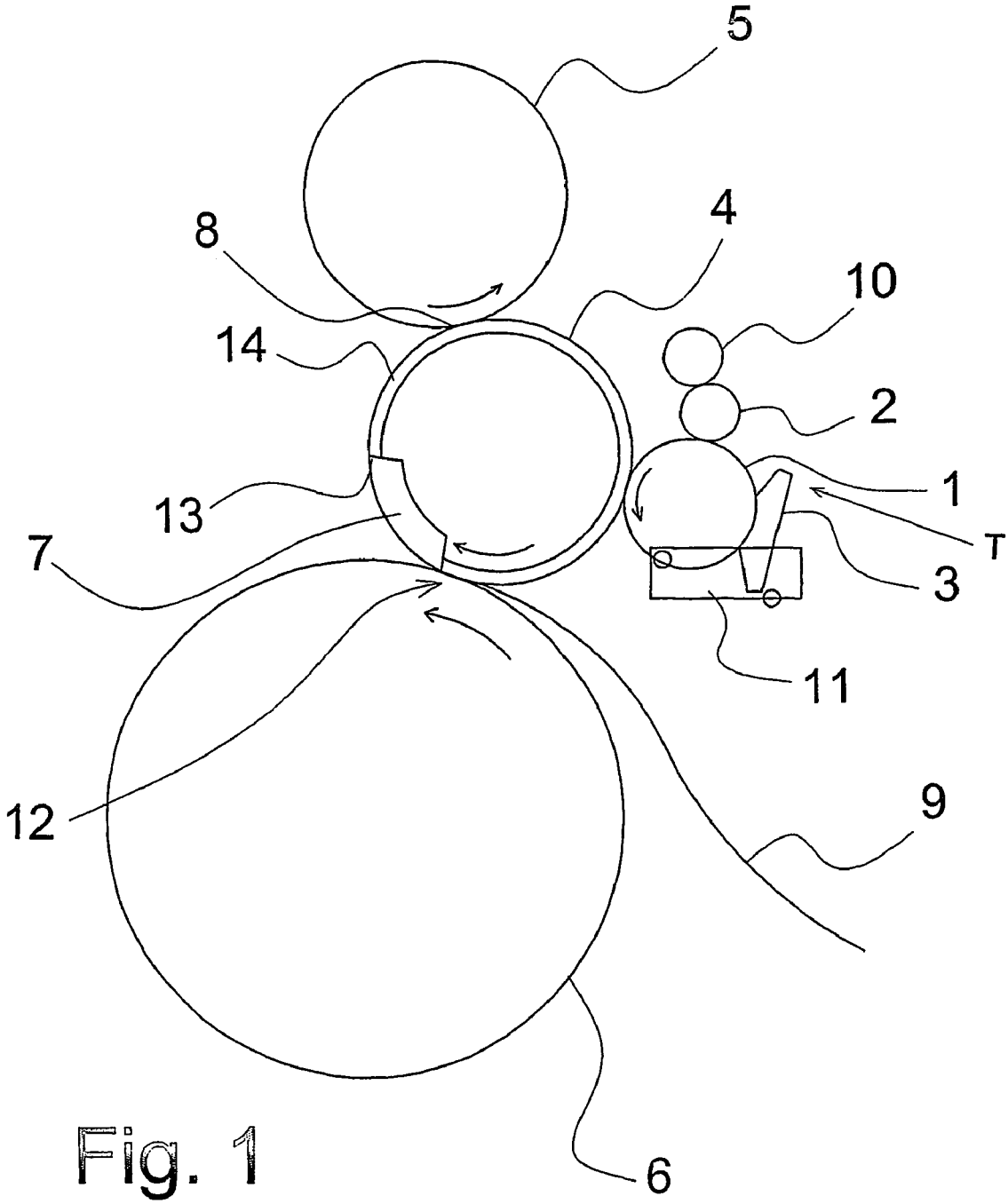
FIG. 1 shows a schematic view of the elements forming part of a printing unit according to the invention.

In FIG. 1 is shown an inking unit T that includes a screen roller 1 rotating in direction of the indicated arrow. The screen roller 1 engages the transmission of the printing machine as indicated by a gear wheel 2. The screen roller can also be driven by a motor 10 for idling of the screen roller.

Figure 7:
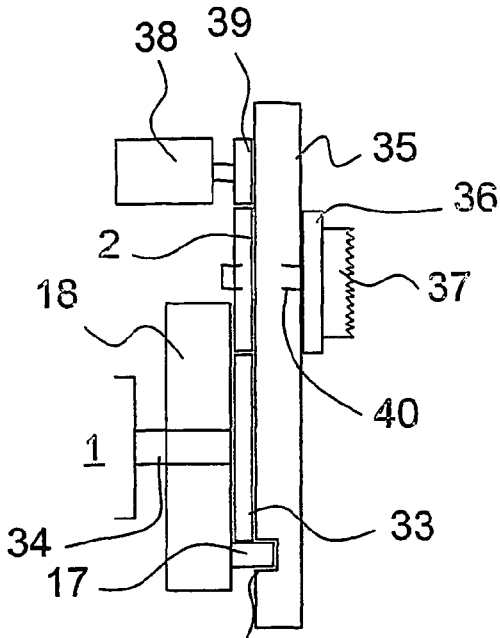
FIG. 7 shows a schematic side view of the parts shown in FIG. 6 and furthermore showing the drive connection for the screen roller.

The screen roller 1 engages a doctor blade system 3 forming part of the inking unit T and which is mounted at a position over a drip pan 11 with the possibility of displacing the screen roller 1 out from and in towards a rubber sheet cylinder 4. In practice this occurs by contact between screen roller and the doctor blade system being maintained and that displacement occurs by swinging the inking unit T. This occurs about an axis guiding the gear wheel 33 of the screen roller (see FIG. 7) through a swinging movement about the gear wheel 2, yet with engagement maintained.

In practice, the motor 10 will have a gear wheel 39 (see FIG. 7) which is in constant engagement with the gear wheels of the printing machine 2 that are engaged or disengage from the drive system of the main machine by using a coupling (not shown) which is activated synchronously with the swinging in and out of the screen roller. The gear wheel 39 is connected with the motor 10 via an idling so that the motor is not driven with when the screen roller 1 is driven by the printing machine.

The rubber sheet cylinder 4 engages a pressing plate cylinder 5 and a back-pressure cylinder 6. A rubber sheet 14 is placed on the rubber sheet cylinder 4 with a channel 7 which is delimited by a front edge 12 and a rear edge 13 of the rubber sheet 14. In FIG. 1 is indicated that a slot 8 can be provided between the rubber sheet 14 and the pressing plate cylinder 5. Furthermore, in FIG. 1 is indicated a sheet 9 which is on its way into the printing unit. The cylinders of the printing unit are rotated in the direction indicated by the arrows.

Figure 2:
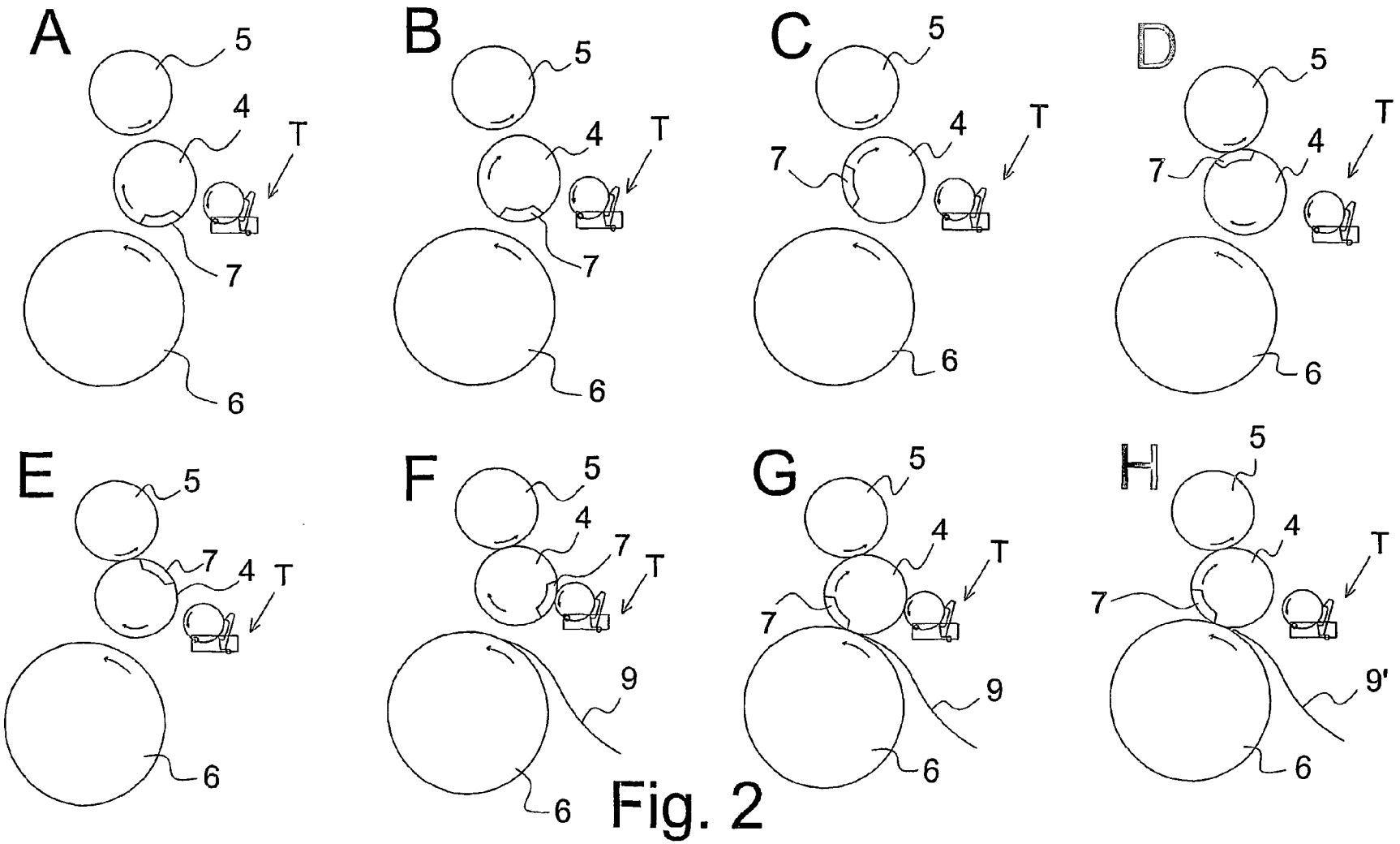
FIG. 2 illustrates different steps by a method according to the invention.

In FIG. 2 are shown different Figures that illustrate different steps of the method.

In the first step A, the printing machine is started and is running standby. In this position, the inking unit T will run in idling by engaging the motor 10.

In the second step B, the printing machine will be set to run idling and is then ready for printing. In this position, the inking unit T will still run in idling which is now occurring by using/coupling in the transmission 2 of the printing machine (not shown curring by using/coupling in the transmission 2 of the printing machine (not shown in FIG. 2).

In the third step C, signal for starting printing in the printing machine is given. At this time, the inking unit will continue to run in idling with the transmission of the printing machine and simultaneously the first sheet is fed into the printing unit. Ink will be applied to the sheet in the printing units (not shown) of the printing machine located at an upstream position in the printing machine.

In the fourth step D, the printing machine will give signal for activation of the printing unit, and the channel 7 in the rubber sheet 14 will be situated at a position opposite the printing plate cylinder 5. The printing unit will now await correct positioning of the channel 7 of the rubber sheet cylinder before swinging in. The first sheet 9 in the system is now on its way into the printing unit according to the invention, and it will be provided with colour print from previous printing units.

In the fifth step E, the printing unit will still be activated, and the channel 7 in the rubber sheet cylinder will now be on its way to a position opposite the screen roller 1 in the inking unit T according to the invention. Now there will given a starting signal to the printing unit which starts its swinging in movement at the same time as the first sheet is on its way into the printing unit.

In the sixth step F, there is still a signal for activating the printing unit, and the channel 7 in the rubber sheet cylinder will now be situated opposite to the screen roller 1 of the printing unit. The screen roller is brought in against the channel for being in engagement with the rubber sheet 14 from its front edge. From now on, lacquer is applied to the rubber sheet. The sheet 9 will now be with its front edge at a position immediately in front of the back-pressure cylinder 6.

In the seventh step G, the printing unit is activated, and the screen roller 1 transfers lacquer/flexographic ink to the rubber sheet 14. The contact pressure against the rubber sheet is adjusted by using interacting bearing means on the inking unit and the printing machine. The sheet 9 will now be provided with lacquer from the front edge of the sheet until it leaves the printing unit.

When the sheet has left the printing unit, the succeeding sheet will come in direct continuation of the first sheet where the screen roller remains in engagement until a time before the last sheet in a print series is inserted on the rubber sheet.

In the eighth step H is shown a situation where the last sheet 9' in a print series is on its way into the printing unit. Here, the screen roller 1 is swung away from the rubber sheet, which has occured when it was opposite the channel 7 at the insertion of the last sheet 9' in a print series in the printing unit. Thus no lacquer/flexographic ink are applied to the rubber sheet during the passage of the last sheet through the printing unit.

Figure 3:
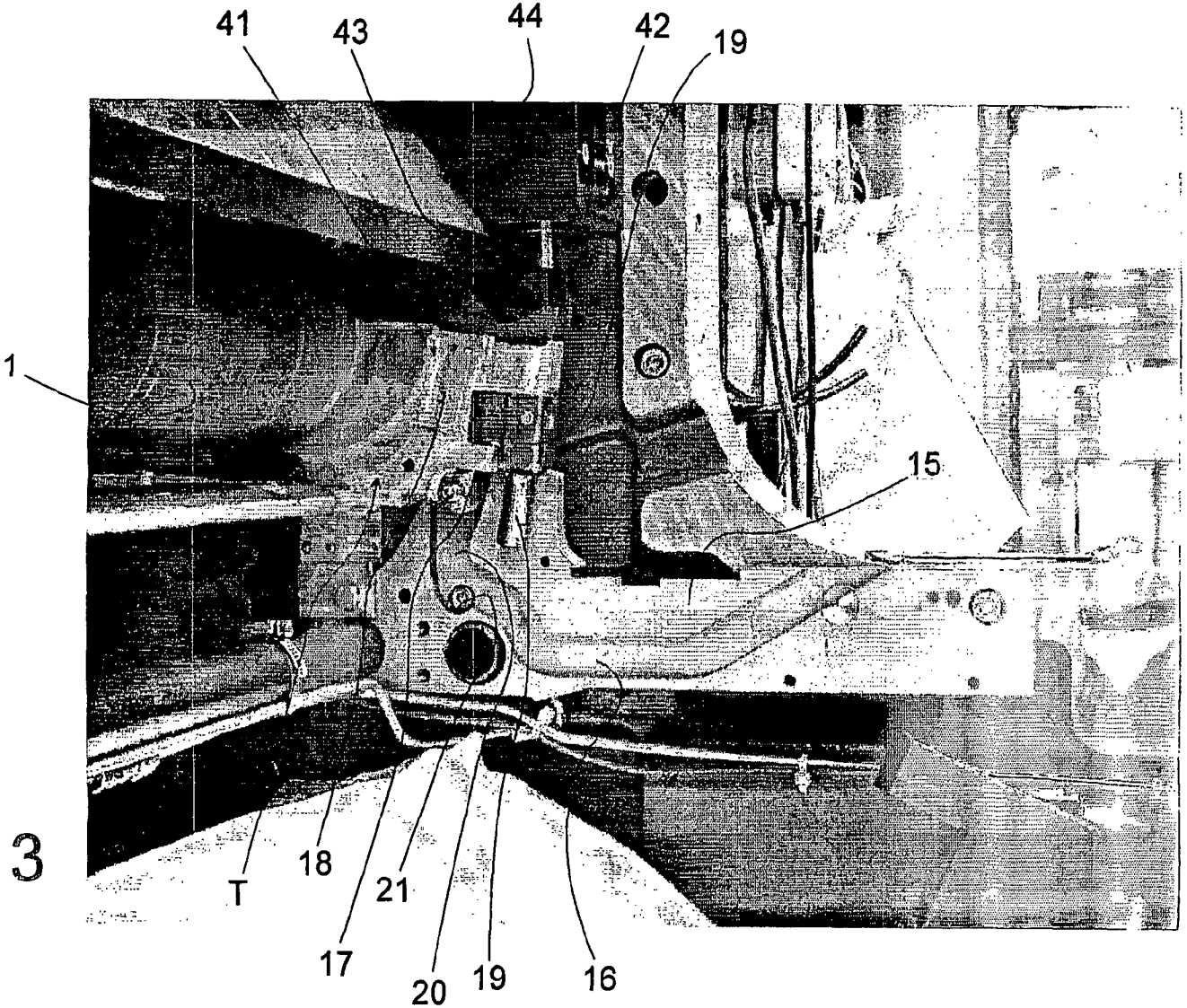
FIG. 3 shows a schematic view of support holders in a printing machine according to the invention with mounted inking unit.

FIG. 3 shows an inking unit T mounted with the screen roller 1 engaging the rubber sheet roller (not visible in FIG. 3). It is noted that the doctor blade system 3 is, not mounted in the inking unit in FIG. 3. The printing machine includes side support holders 15 which are provided with grooves 16 that interact with guide means in the form of pins 17 on side plates 18 in the inking unit T.

Figure 4:
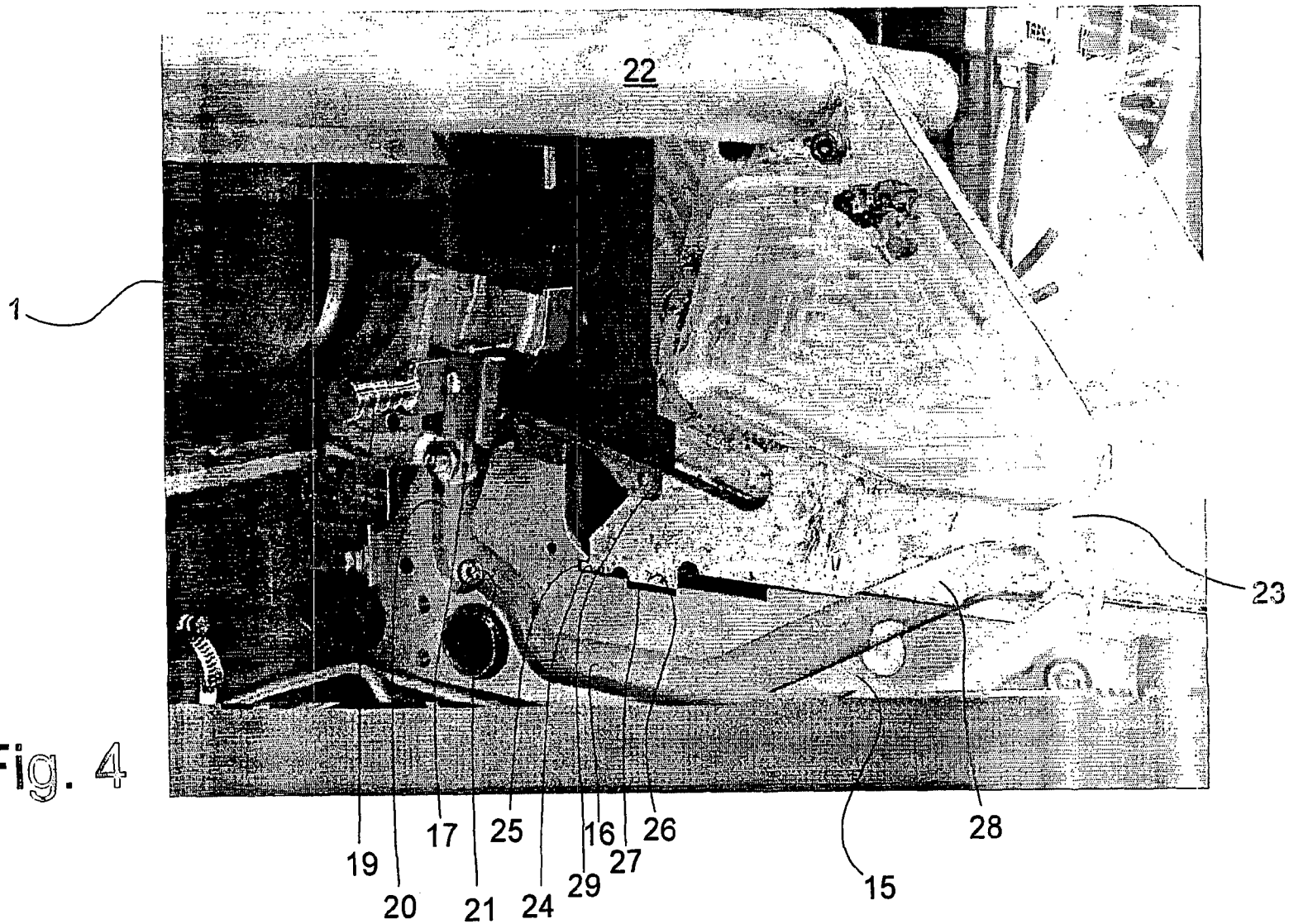
FIG. 4-5 show schematic views of support holders in a printing machine according to the invention that interact with side plates in a tool according to the invention with the inking unit during dismounting.
Figure 5:
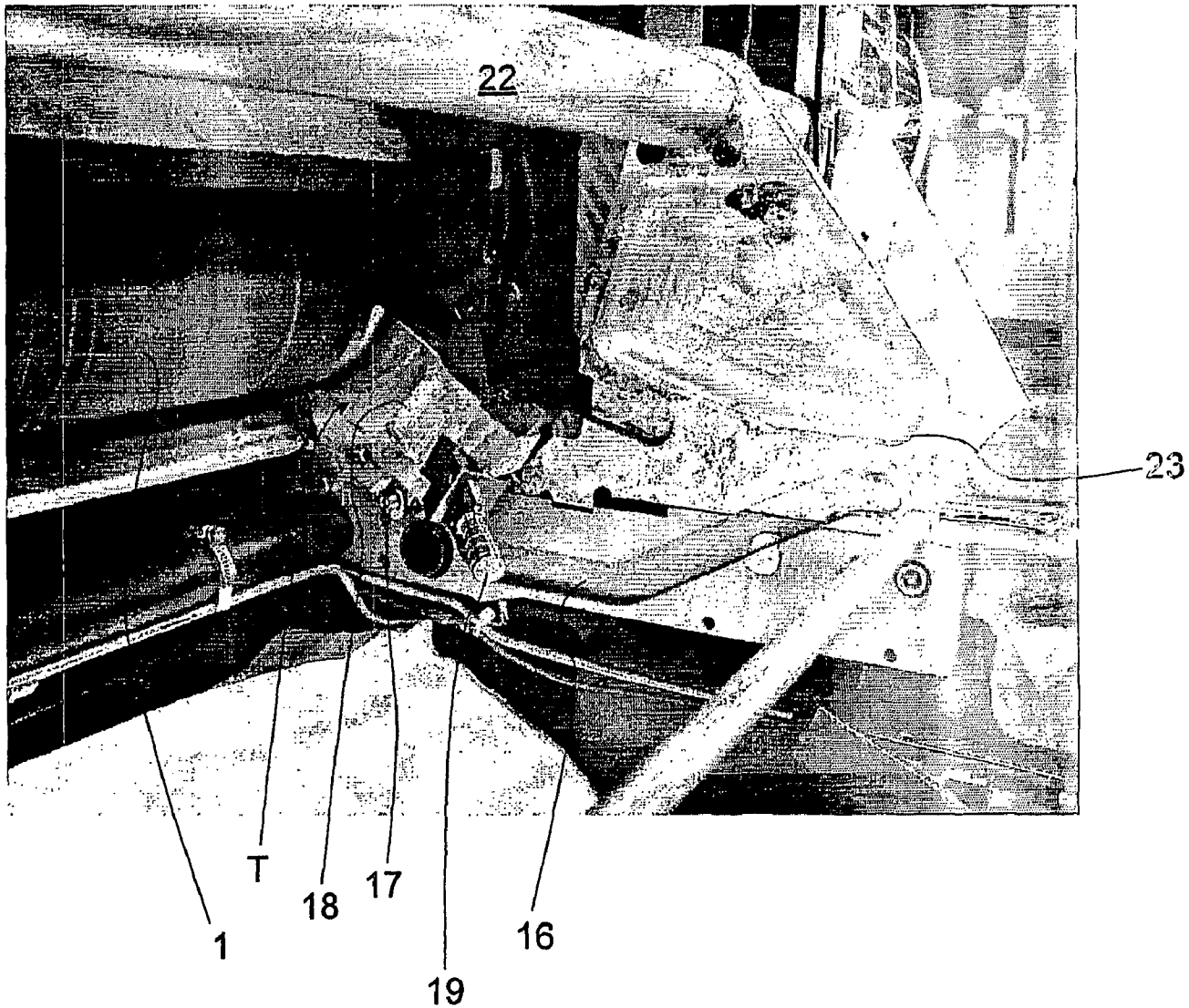

The side plates 18 are provided with a locking means 19 that enable securing of the inking unit T in the engaging position. The locking means 19 interact with side support holder 15 and may be swung to a free position as illustrated in FIGS. 4 and 5.

The groove 16 has a first part 20 ending in a first downwards directed hollow 21 in which a guide pin 17 can rest at commencing release of the inking unit. This enables dismounting and mounting the inking unit as well as washing facility in a secure and controlled way without any risk of damaging parts of the machine at mounting/dismounting. When the washing facility is moved to its first rest position, it will assume a position as illustrated in FIG. 5.

FIG. 3 furthermore shows a bearing means 41 in the shape of a surface at the top side of the side plate 18 of the printing unit. This bearing means interacts with a bearing means 42 on the printing machine. The bearing means 42 is provided in the shape of a spindle 43 which is actuated by a worm situated in a housing 44. The worm can be connected with a transverse rod connection in order to activate a corresponding worm drive and adjusting spindle at the opposite side of the printing unit. By extending the piston 43 more or less from the housing 44, it becomes possible to press on the side plate 18, whereby the inking unit is imparted a swinging movement that moves it closer to the rubber sheet cylinder or farther from the rubber sheet cylinder, whereby the bearing pressure is adjusted.

According to a particular embodiment, it is possible to incorporate a meter, e.g. a potmeter, in the worm housing 44. This may be combined with a meter measuring the position of the rubber sheet which also can be provided by means of a potmeter. Hereby, it becomes possible to give a signal from a control unit so that secure knowledge of the mutual position of the rubber sheet 14 and the screen roller 1 is obtained. The bearing pressure may hereby be adjusted, e.g. with regard to varying paper thicknesses.

In FIG. 4 is illustrated a tool 22 according to the invention. The tool 22 is provided with side plates 23 resting on each their support holder 15 in the printing machine. The side plates 23 are provided with positioning means 24 in the form of a pin that interact with positioning means in the shape of a groove 25 in the support holder 15 of the printing machine. Further positioning occurs by interaction between an interacting part 26 on the side plate 23 which interacts with a groove 27 in the support holder 15. When the side plate is mounted correctly, a first auxiliary groove 28 in the side plate will be aligned with the groove 16. Via an adjustable closing plate 30, a further auxiliary groove 29 in the side plate 23 will be in contact with the upper side of the support holder 15.

Hereby it is possible that a second guide pin 17' (see FIG. 6), which is placed in the side plate 18 of the inking unit, is brought to engaging the further auxiliary groove 29, while the first guide pin 17 after passing the groove 16 is brought into engaging the auxiliary groove 28 in the tool 22.

Figure 8:
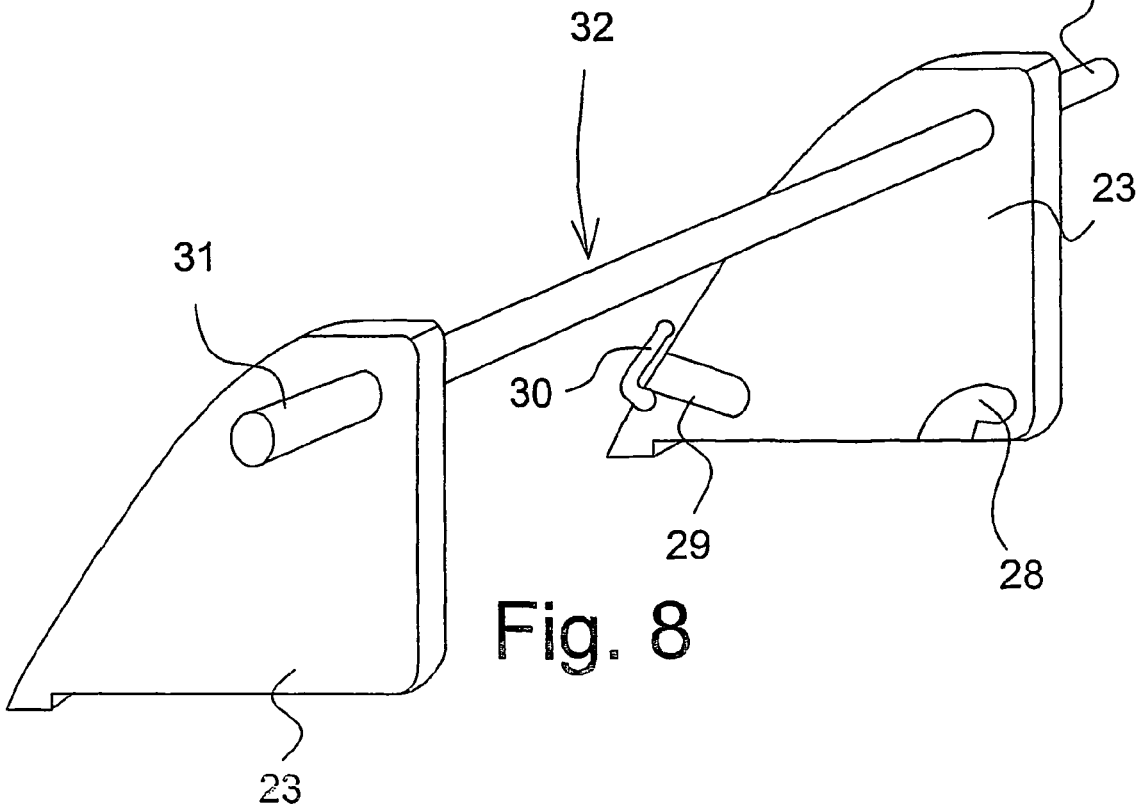
FIG. 8 shows a schematic view of a tool according to the invention.

When the inking unit T is disposed in the auxiliary guide grooves 28, 29, the plate 30 is swung upwards to a locking position as illustrated in FIG. 8. The inking unit, or alternatively the washing facility, will hereby be placed in the auxiliary guide groove in a position situated under carrier handles 31 disposed at the upper side of the tool 22. The carrier handles 31 are formed as handles on a through-going rod 32 passing through the side plates 22. The auxiliary tool enables for one person at each end of the printing machine to mount and dismount washing facility/inking unit without any ergonomically disadvantageous working positions. In practice it has furthermore appeared that mounting/dismounting by means of the tool reduces the shifting time to one-fifth of the shifting time without using auxiliary tool. Furthermore, use of the tool 22 provides a complete controlling of the way in which mounting and dismounting occurs, so that the washing facility/inking unit never come in inadvertent contact with the printing machine with consequent risk of damaging machine parts.

In FIG. 4 is seen that the lock 19 is swung into an open position whereby the first guide pin 17 can pass into the first part 20 of the groove 16.

In FIG. 5, the first part of the dismounting movement is shown, where the inking unit is situated with the guide pin 17 in the resting position 21 at the bottom of the first part 20 of the groove 16. In this position, a slightly outwards pull in the inking unit will cause that the second guide pin 17' is moved beyond the support holder and the plate 30, into the further auxiliary groove 29 simultaneously with the first guide pin 17 being moved through the groove 16 to placing at the bottom of the auxiliary guide groove 28 in the side plate 23 of the tool.

Figure 6:
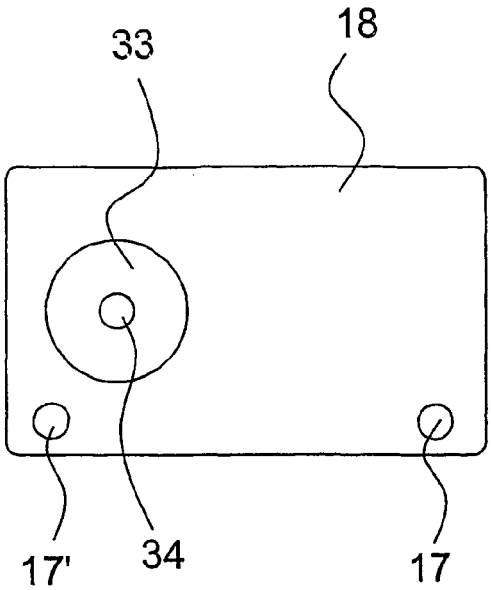
FIG. 6 shows a schematic partial view of guiding means on a side plate of the printing unit.

FIG. 6 illustrates schematically the positioning of the guide pins 17, 17' projecting from the side plate 18 in the inking unit. Furthermore, FIG. 6 illustrates a gear wheel 33 which is mounted on the axle 34 supporting the screen roller 1. The gear wheel 33 is situated at an outwards facing position of the side plate 18. The gear wheel 33 engages the gear wheel 2 for the transmission of the printing machine. Via a shaft 40 passing through the lateral flange 35 of the printing machine, the gear wheel 2 engages a drive gear wheel 36 connected to the drive unit of the main machine. The connection between gear wheels 36 and 32 is established by means of a coupling 37 that enable disengagement of the gear wheel 2 from the engagement with the gear wheel 36. By activating/deactivating the coupling 37, one may freely choose whether the gear wheel 2 is to be freely rotating or driven by the main drive unit via the engagement with the gear wheel 36.

When the gear wheel 2 is rotating freely, idling can be established by activating a motor 38 which via the gear wheel 39 drives the gear wheel 2 and thereby the screen roller 1. The continuous rotation of the screen roller 1 is hereby established, irrespectively whether the printing machine is operating or not In FIG. 8 is seen that the tool 22 includes two side plates 23 that are mutually connected via the rod 32. In the internal side of each side plate there is provided auxiliary guide grooves 28, 29 so that the washing facility/inking unit can be received at a position located under the carrier handles 31. The tool 22 may thereby be used for lifting the washing facility/inking unit by mounting and dismounting.

It is noted that the above embodiment is just a concrete embodiment for a system according to the invention. Other embodiments will also be possible within the scope of the subsequent claims. The drive arrangement may thus be provided with other means than gear wheels, e.g. friction wheels or toothed belts. Furthermore, guide pins and guide grooves may be mutually exchanged so that guide pins are situated on the support holder of the printing machine instead of the inking unit/washing facility. Furthermore, guide grooves may have other embodiments than the shown embodiments, if only it is ensured that dismounting and mounting occurs without interference between machine parts.

The invention claimed is:

1. Printing unit for printing with flexographic inks and lacquer in an offset printing machine that includes a printing plate cylinder, a rubber sheet cylinder, a back-pressure cylinder and an inking unit which includes a screen roller in engagement with a doctor blade system and which is arranged for continuous rotation by engaging a motor in a situation where the printing machine is not operating and by engaging a transmission of the printing machine when the printing machine is operating, the screen roller being arranged for swinging in and out of engagement with the rubber sheet cylinder which has an axially oriented channel limited by a front edge and a rear edge of a rubber sheet, wherein the inking unit is adapted for being mounted in a support holder of the printing machine for a washing facility for the rubber sheet on the rubber sheet cylinder.

2. Printing unit according to claim 1 and for an offset printing machine adapted for printing sheets, characterized in that the screen roller is arranged for swinging against the rubber sheet cylinder opposite the duct in order to be in contact with the rubber sheet from its front edge.

3. Printing unit according to claim 2, characterized in that the screen roller is arranged for swinging away from the rubber sheet cylinder opposite the channel in order to be in contact with the rubber sheet to its rear edge.

4. Printing unit according to claim 1, characterized in that interacting bearing means on the inking unit and the printing machine are provided for adjusting the contact pressure of the inking unit against the rubber sheet.

5. Printing machine with a printing unit according to claim 1, characterized in that at each end of the inking unit there are projecting guide means which are arranged for interacting with at least one guide groove formed in the support holder of the printing machine at each end of the rollers and which interacts with projecting guide means on the washing facility.

6. Tool for use in mounting and dismounting the washing facility and the inking unit in a printing machine according to claim 5, characterized in that it includes two side plates that each are provided with positioning means interacting with corresponding positioning means in the support holder of the printing machine and auxiliary guide grooves that are aligned with the guide grooves in the support holder of the printing machine when the positioning means engage, the guide grooves and auxiliary guide grooves being adapted for receiving the washing facility/inking unit at a position situated under carrier handles formed at an upper side of the tool, preferably on the side plates, and which is used for lifting when mounting and dismounting the washing facility and the inking unit.

7. Method of operation for printing with flexographic inks and lacquer in an offset printing machine which includes a printing plate cylinder, a rubber sheet cylinder, a back-pressure cylinder and an inking unit which includes a screen roller engaging a doctor blade system and which is continuously rotated by engaging a motor in a situation where the printing machine is not operating and by engaging a transmission of the printing machine when the printing machine is operating, the screen roller being arranged for swinging in and out of engagement with the rubber sheet cylinder which has an axially oriented channel limited by a front edge and a rear edge of a rubber sheet, wherein the inking unit is displaced in a support holder of the printing machine for a washing facility for the rubber sheet on the rubber sheet cylinder for mounting and dismounting, respectively, by substituting with the washing facility.

8. Method according to claim 7 and for offset printing on sheets, characterized in that the screen roller is swung in and out of engagement with the rubber sheet cylinder, as it is brought in contact with the rubber sheet from its front edge simultaneously with a first sheet in a series of prints is inserted in the printing unit.

9. Method according to claim 7, characterized in that the screen roller is swung against the rubber sheet cylinder opposite the channel in order to be in contact with the rubber sheet from its front edge.

10. Method according to claim 8, characterized in that the screen roller is swung away from the rubber sheet cylinder opposite the channel at the penultimate sheet in a printing series in order to be in contact with the rubber sheet at its rear edge.

* * * * *